United States Patent [19]

Shook et al.

[11] Patent Number: 4,793,734

[45] Date of Patent: Dec. 27, 1988

[54] APPARATUS FOR REMOVING STRUCTURAL CONCRETE

[75] Inventors: Forrest A. Shook, Fenton; Gerard J. DeSantis, Battle Creek, both of Mich.

[73] Assignee: NLB, Wixom, Mich.

[21] Appl. No.: 111,500

[22] Filed: Oct. 22, 1987

[51] Int. Cl.[4] ..... E01C 23/12; B05B 3/02

[52] U.S. Cl. ..... 404/90; 299/17; 299/37; 299/41; 239/227; 239/288.3; 239/752; 175/424

[58] Field of Search ..... 404/75, 90, 91; 299/13, 299/14, 17, 36, 41, 37; 239/148, 160, 162, 172, 227, 228, 288.3, 288.5, 600, 752; 175/67, 424

[56] References Cited

U.S. PATENT DOCUMENTS

| | | | |
|---|---|---|---|
| 2,106,035 | 1/1938 | Mall | 299/41 X |
| 2,684,558 | 7/1954 | Harris et al. | 51/424 |
| 3,231,031 | 1/1966 | Cleary | 175/424 X |
| 3,347,597 | 10/1967 | Holifield | 299/36 |
| 3,576,222 | 4/1971 | Acheson et al. | 175/424 X |
| 3,614,163 | 10/1971 | Anderson | 299/14 |
| 3,688,853 | 9/1972 | Maurer et al. | 175/424 X |
| 3,778,109 | 12/1973 | Anderson et al. | 299/14 |
| 3,792,907 | 2/1974 | Anderson | 299/17 |
| 3,796,463 | 3/1974 | Naydan et al. | 299/14 |
| 3,811,795 | 5/1974 | Olsen | 417/53 |
| 3,857,516 | 12/1974 | Taylor et al. | 239/186 |
| 3,905,608 | 9/1975 | Olsen et al. | 277/188 |
| 3,960,407 | 7/1976 | Noren | 299/17 |
| 4,026,322 | 5/1977 | Thomas | 137/512 |
| 4,074,858 | 2/1978 | Burns et al. | 404/90 X |
| 4,081,200 | 3/1978 | Cheung | 299/17 |
| 4,111,490 | 9/1978 | Liesveld | 299/17 |
| 4,119,160 | 10/1978 | Summers et al. | 175/424 X |
| 4,195,885 | 4/1980 | Lavon | 299/1 |
| 4,204,715 | 5/1980 | Lavon | 299/16 |
| 4,219,155 | 8/1980 | Goerss | 239/124 |
| 4,221,271 | 9/1980 | Barker | 175/424 |
| 4,289,275 | 9/1981 | Lavon | 239/101 |
| 4,306,627 | 12/1981 | Cheung et al. | 175/424 |
| 4,562,964 | 1/1986 | Diamond | 239/288.5 |
| 4,619,551 | 10/1986 | Juan et al. | 299/36 X |
| 4,637,656 | 1/1987 | Medeot | 299/36 X |
| 4,640,644 | 2/1987 | Puchala et al. | 299/36 X |
| 4,683,684 | 8/1987 | Yie | 299/41 X |

*Primary Examiner*—Jerome W. Massie
*Assistant Examiner*—John F. Letchford
*Attorney, Agent, or Firm*—Cullen, Sloman, Cantor, Grauer, Scott & Rutherford

[57] ABSTRACT

Apparatus for removing structural concrete comprises an elongated hood having an inner generally non-accessible zone, an outer zone accessible for performing maintenance functions and an elongated slot between the zones. A reciprocal feed carriage is guidably mounted within the hood in the inner zone and mounts a seal support housing within the outer zone. Portions of the housing extend through the slot into the inner zone and are pivotally mounted upon the carriage. A rotating shaft and seal assembly is mounted upon the seal support housing in the outer zone, including a body having a water inlet adapted for connection to a source of water under pressure. An elongated tubular shaft and nozzle assembly is axially connected to the rotatable seal and shaft assembly and extends from the seal support housing through the slot into the inner zone of the hood, through the carriage and into the bottom of the hood for directing water under pressure against the structural concrete. The seal support housing and the component parts located thereon are mounted for a pivotal rotation, with the tubular shaft and nozzle assembly movable in an arc through the slot into the outer zone of the hood where the tubular shaft and nozzle assembly may be conveniently serviced, repaired and maintained.

27 Claims, 5 Drawing Sheets

APPARATUS FOR REMOVING STRUCTURAL CONCRETE

FIELD OF THE INVENTION

The present invention is used in the field of structural concrete renovation and relates to an apparatus for removing hardened structural concrete from existing structures including steel-reinforced concrete structures. Specifically, this type of apparatus, for example, may be used in the repair of bridge spans, highways, roads, concrete slabs, airport runways, parking decks, concrete floors in industrial plants and other building structures by removing the defective areas or regions of deteriorated concrete. This type of apparatus may also be used in the preparation of existing structures to make additions to the structures by removing old or deteriorated concrete in regions where joints are intended and also where reinforcing bars may be exposed for subsequent embedment in new concrete poured or used in constructing the additions.

RELATED PATENT APPLICATION

This patent application is related to the pending patent application of Applicants' assignee, Ser. No. 902,234, filed Aug. 29, 1986, now U.S. Pat. No. 4,753,549, entitled "Method and Apparatus for Removing Structural Concrete."

BACKGROUND OF THE INVENTION

In the above co-pending patent application there is disclosed a method and an apparatus for removing deteriorated structural concrete from a road bed, for illustration, where the action of the water jetting against the concrete in a systematically controlled manner under pressures up to 25,000 p.s.i. results in areas of the structural concrete being removed to required depths to expose the steel reinforcing bars. The high pressure rotating water jets travel back and forth over the work area removing the structural concrete under controlled conditions. The weakened concrete is removed without damaging the reinforcing bars and at the same time scale and corrosion are removed from the steel bars.

One problem encountered with prior art apparatuses designed to remove structural concrete which has deteriorated is the difficulty of obtaining access to the nozzle assembly, for maintenance, repair and the replacement of nozzles or orifices when required due to the inconvenient location of the nozzle assembly lower most within the hood or hood assembly.

Another problem is that prior art apparatuses are not constructed to exclude water and debris from the area surrounding the hood, and from internal areas of the hood including the carriage and the drive mechanism for moving the carriage in the hood.

With prior art apparatuses, concrete, stones and other debris from the concrete break up chamber located within the hood escaped to other areas of the hood causing damage to the carriage or the carriage roller supports. There exists the possibility of high pressure water entering the interior or inner zone or region of the hood into the feed mechanism, or the carriage and into the power drive mechanism for the tubular shaft support and nozzle assembly.

Thus, certain of the component parts of the prior art apparatuses have been and are subject to a dirty environment which substantially decreases the useful life of the parts.

SUMMARY OF THE INVENTION

The present invention relates to an apparatus for removing deteriorated structural concrete, and more particularly to an apparatus, including a hood having an inner generally non-accessible zone or region and an outer zone or region which is accessible for performing maintenance functions on the nozzle assembly and other components. A reciprocal feed carriage is guidably mounted within the hood. A rotating seal and shaft assembly mounted upon the carriage in the outer zone of the apparatus is connected to a source of water pressure up to 25,000 p.s.i., and includes a tubular shaft and nozzle assembly which normally extends into the inner zone of the apparatus down into the hood for pressure water impingement against the structural concrete. The seal and shaft assembly is pivotally mounted upon the reciprocal carriage so that the tubular shaft and nozzle assembly may be rotated out of the inner zone of the hood to the outer zone for servicing and maintenance functions.

An important feature of the present invention is to provide an apparatus for removing deteriorated structural concrete including a hood having an interior generally non-accessible zone and an outer zone accessible for performing maintenance functions and a reciprocal feed carriage guidably mounted within the hood for supporting a rotating seal and shaft assembly which is adapted to be connected to a source of water under pressure and to a tubular shaft and nozzle assembly for directing the high pressure water against the deteriorated structural concrete.

Another feature is that the tubular shaft and nozzle assembly normally extends into the inner zone of the the hood for water pressure impingement against the structural concrete.

Still another feature is that the tubular shaft and nozzle assembly is pivotally mounted upon the carriage so that the assembly may be rotated to an outer accessible zone of the hood for servicing, repair and replacement purposes.

A further feature is to position a seal support housing which overlies the carriage and is located in the outer zone of the hood. With such a construction, the rotating shaft and seal assembly is mounted upon the support housing within the outer zone of the hood, remote from the concrete break up chamber within the hood and remote from the flying debris and water.

A still further feature is to provide power means, including a hydraulic motor and drive shaft mounted upon the support housing positioned within the outer zone of the hood, with the hydraulic motor drive shaft extending into the seal support housing and being coupled to the rotating shaft and seal assembly upon the interior of the housing so as to operate in a clean environment free of water, dust and stones.

Another feature is to provide on the top of the reciprocal carriage a support housing for the tubular shaft and nozzle assembly so that the housing overlies the carriage and is secured thereto and includes a pivot means by which the support housing and connected shaft and nozzle assembly may be pivoted from an upright position to a substantially horizontal position within the outer zone of the hood for easy access to the nozzle assembly for repair, replacement and maintenance purposes.

Still another feature is to provide a support housing in the outer zone of the hood for the rotating shaft and seal assembly which includes portions which extend through a longitudinal slot in the hood into the inner zone thereof for connection to the carriage together with pivot means which are interposed between the housing portion and the carriage so that the rotating shaft and seal assembly may be swung through the slot to a generally horizontal position within the outer zone for maintenance purposes. This provides easy access to the nozzle assembly, to the nozzle block, cover wear plate, water nozzles, and to the mounting for the nozzle assembly for maintenance purposes.

A further feature is to provide and locate the rotating shaft and seal assembly and the hydraulic drive motor therefore above the top of the carriage housing. In such a construction, an elongated tubular shaft and nozzle assembly is axially connected to the rotating seal and shaft assembly and normally extends from the seal assembly through the carriage into the break up chamber within the inner zone of the hood, with the nozzle assembly being removably mounted upon the end of the tubular shaft.

Still another feature is to provide for the elongated tubular shaft and nozzle assembly longitudinally spaced radial bearings within the tubular bearing housing which receives the tubular shaft. In such a construction, the bearing housing at its upper end is rigidly affixed to the support housing and adapted for pivotal movements therewith.

A further feature is to protect the tubular bearing housing and the bearings therein from erosion by a metal protective sleeve which is positioned over the bearing housing and is removably held on the housing by a pair of quick release spring loaded pins. With such a construction, the protective sleeve may be raised and lowered relative to the tubular shaft as desired for access to the nozzle assembly.

Another feature for the protection of the nozzle and the bottom portion of the nozzle block from rapid erosion is to provide an apertured hardened steel cover plate which is bolted to the nozzle block.

Still another feature is to space the lower or bottom portion of the hood from the structural concrete and to apply a peripheral skirt of a flexible material to and around the bottom of the hood, with lower portions thereof throughout 360! located closely adjacent to the structural concrete thereby defining a protective enclosure within the hood against escape of debris and pressurized water.

A further feature is to provide upon the seal support housing flange portions which extend through the slot in the hood into the inner zone thereof. Such flange portions are connected to the carriage by opposed pairs of longitudinally spaced fasteners extending between the portions and the carriage. With such a construction upon removal of one of the pairs of fasteners, the other pair of fasteners serves as a pivot means whereby the seal support housing may be pivoted through an arc to thereby move the tubular shaft and nozzle assembly to a generally horizontal inspection and service position into the outer zone of the hood for servicing.

Another feature is to provide a power means for effecting longitudinal reciprocal movements of the carriage with respect to the hood which include one or a pair of sprocket chains. In such a construction, the chains at their ends extends to and are mounted around drive and idler sprockets adjacent opposite ends of the hood. A reversible motor and a drive shaft are mounted upon the hood. The drive shaft is connected to the drive sprocket or sprockets. A clamp means is provided upon the carriage and is and secured to the sprocket chain or chains. The hydraulic motor for the carriage feed has a pair of pressure fittings adapted for alternate connection to a source of fluid under pressure.

Still another feature includes the formation of a apertured partition across an upper portion of the hood below the carriage into which the tubular shaft and nozzle assembly extends sometimes referred to as a concrete break up chamber. In such construction, a sealing means is provided for restraining debris and water upon the interior of such break chamber against movement into the area of the hood within which the carriage is movable.

Another feature is to provide a nozzle construction which includes a nozzle protected from rapid errosion by a removable cover plate bolted to the nozzle block in which the nozzle is located.

These and other features and objects will be seen from the following specification and claims in conjunction with the apended drawings.

IN THE DRAWINGS

It will be understood that the above described drawings illustrate merely a preferred embodiment of the invention, and that other embodiments are contemplated within the scope of the claims hereafter set forth.

DETAILED DESCRIPTION OF AN EMBODIMENT OF THE INVENTION

Figure 1:
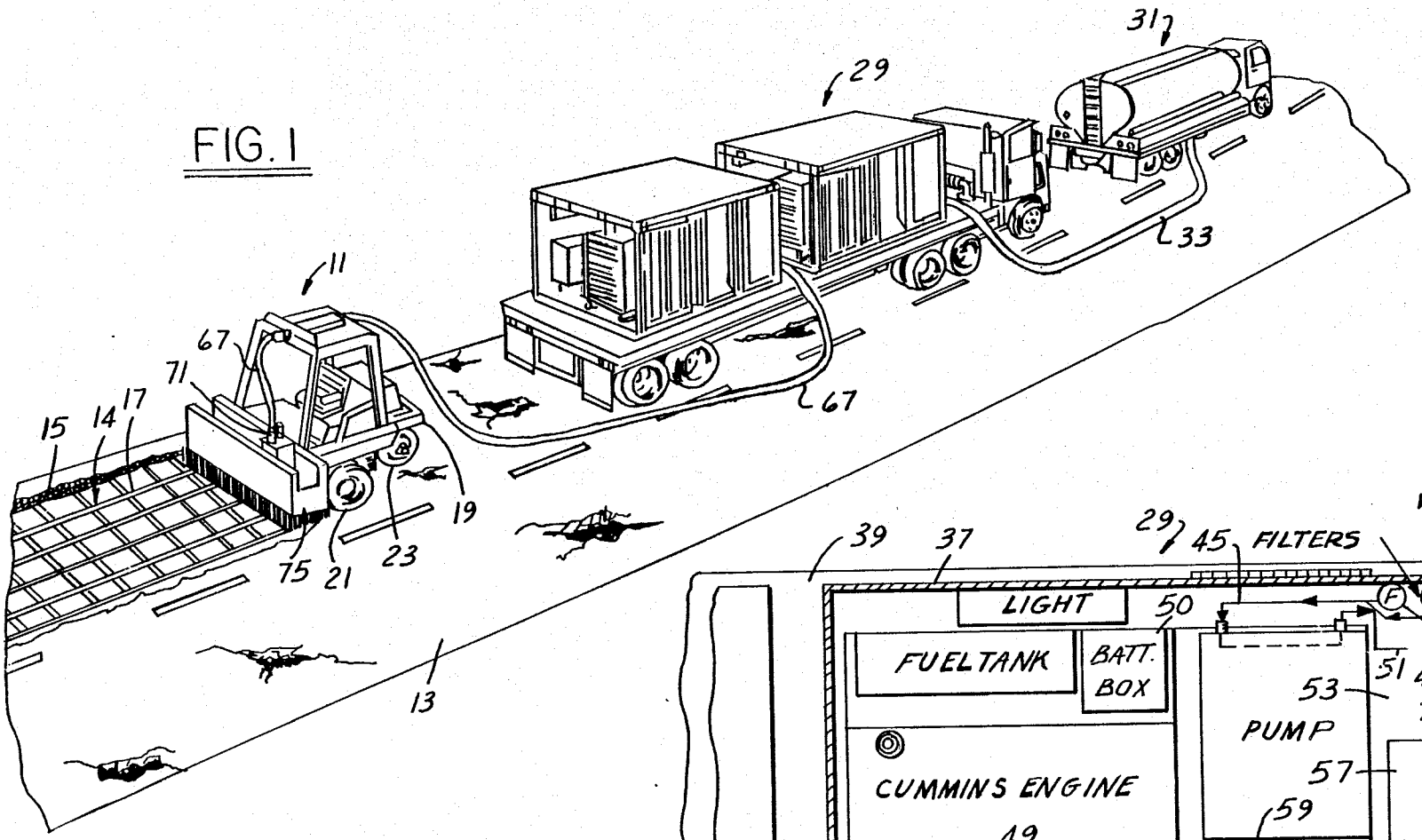
FIG. 1 is a fragmentary perspective view of equipment and vehicles used for removing structural concrete including a water jet blasting vehicle located upon a road bed or other structural concrete, a water storage and pump vehicle and a motorized water storage tank truck.

Referring to FIG. 1, a high pressure water blaster apparatus or vehicle 11 is movably mounted for longitudinal feed increments upon the structural concrete road bed or road surface 13. A water blasted area is generally designated at 14 over which the vehicle 11 has already moved for removing structural concrete over an area defined by the substantial width of the cut area achieved by longitudinal feed movements of water blaster apparatus 11.

There is shown in FIG. 1 in connection with the water blasted area 14 a cut away top layer 15 which may have been removed by an apparatus other than apparatus 11. The steel reinforcements 17 are exposed in lower portions of the illustration adjacent the water blasted area 14. The water blaster vehicle 11 has a frame 19 mounted upon wheels which include a pair of drive wheels 21 and a centrally arranged steering wheel 23. Internal drive mechanism including engine 73, FIG. 4, is adapted to effect incremental longitudinal feed movements of vehicle 11 in limited amounts, as for example, 4 inches to 6 inches at a time. This is more fully disclosed in copending patent application Ser. No. 902,234 filed Aug. 29, 1986. The water blaster apparatus 11 includes within a hood high pressure rotating jets which are adapted to travel back and fourth transversely over the work area removing structural concrete to a required depth such as shown at 14, FIG. 1. Wheel 23 has a support yoke 25 rotatable upon a vertical axis 27 and a remote steering control or steering wheel 28 adjacent seat 30 within vehicle 11, FIGS. 3 and 4.

The water storage tank truck 31 includes a flexible hose 33 adapted for connection to water inlet 35 of water storage and pump vehicle 29. Associated with the present water blaster vehicle 11 and mounted upon the structural concrete or road bed 13 or adjacent thereto is the water storage and pump vehicle 29 which has upon one sidewall thereof a high pressure water outlet 65, FIG. 2, to which is connected by quick disconnect fitting flexible high pressure water hose 67. The hose 67 is adapted to carry water under pressures up to 25,000 p.s.i., as an example, or the pressure of water required to remove the concrete.

Figure 2:
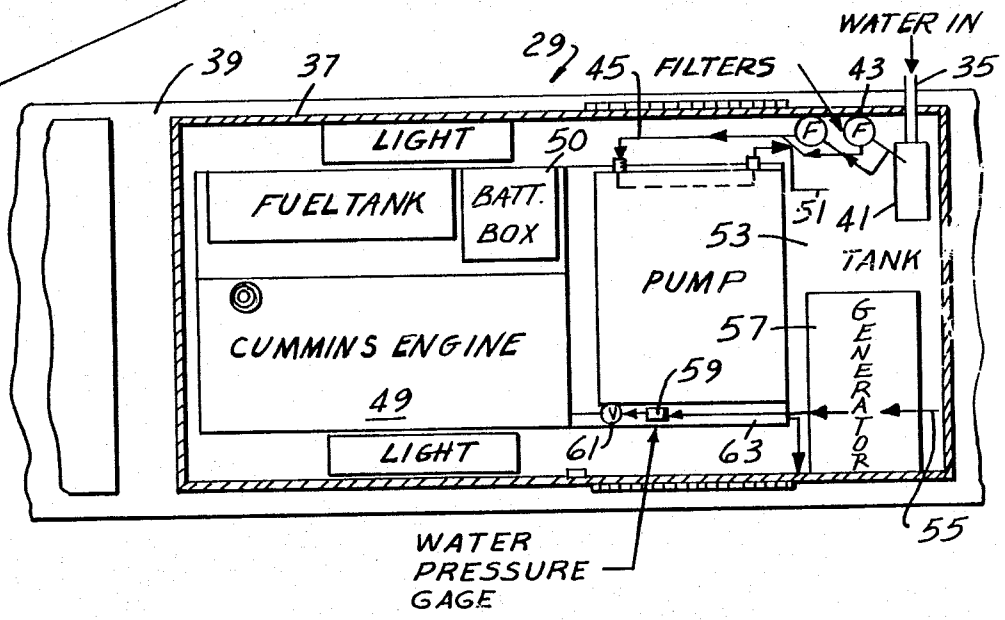
FIG. 2 is a fragmentary plan section of the water storage and pump vehicle shown in FIG. 1, with parts broken away for illustration purposes.

Pump vehicle 29 includes the body 37 which is mounted upon bed 39 as shown in FIG. 2. A receiver 41 within the body 37 is connected to the water inlet 35 for delivering water through the respective filters 43 and conduit 45 into the high pressure pump 47. A suitable engine 49 is mounted on the bed 39 within the 37 body, such as a Cummins diesel drive 335 horse power engine. The engine 49 has an output shaft 52 connected to pump 47. The power source includes 12 volt storage batteries shown at 50 in the illustrative embodiment of FIG. 2.

High pressure conduit 51 from pump 47 feeds pressurized water into the tank 53. The tank 53 has an outlet conduit 55 which extends into and drives the electric generator 57 for generating up to 5,000 watts of electricity for charging the batteries 50. Conduit 55 delivers the water under pressure into discharge manifold 63 having pressure gage 59. This gage may register up to 30,000 p.s.i. and is in communication with pressure relief valve 61. In normal operation the valve 61 may be set at 25,000 p.s.i., for illustration. Pressurized water from tank 53 is dischargable through the high pressure outlet 65 and through the high pressure conduit 67 which is connected to vehicle 11 as shown in FIG. 1.

Figure 6:
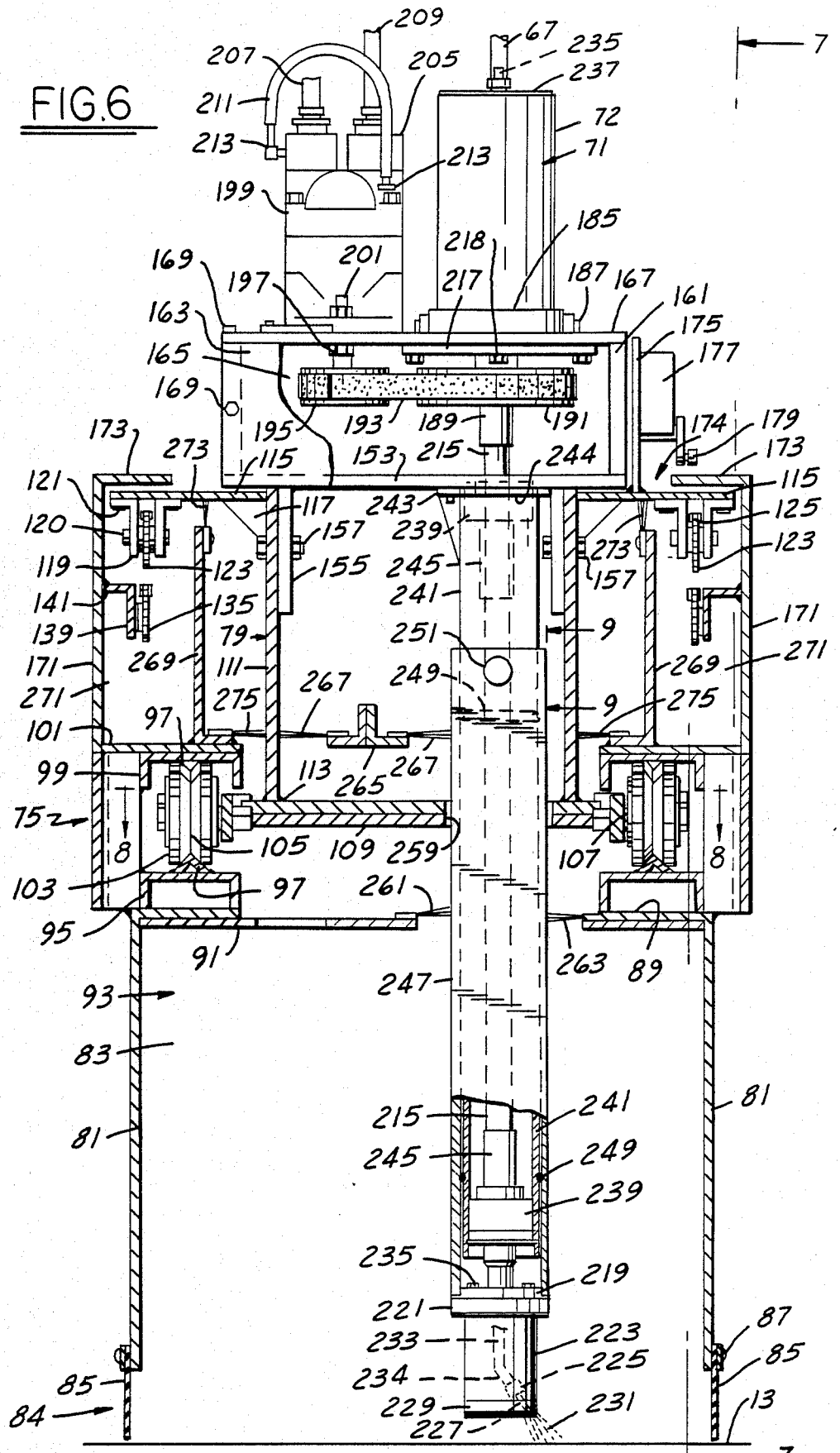
FIG. 6 is a vertical view of the hood and carriage, partly in section, looking in the direction of arrows 6—6 of FIG. 5.

Support tube 69 or bracket is secured to the roof 70 of vehicle 11 for holding and retaining an intermediate portion of conduit 67. The conduit 67 is connected to high pressure water inlet 235 of the rotary seal and shaft assembly 71, as illustrated in FIGS. 4 and 6. The assembly 71 includes a cylindrical body 72 whose cover 237 has a water inlet 235. Inlet 235 is connected by conduit 67 to the water tank 53 located in vehicle 29, FIG. 2.

Figure 3:
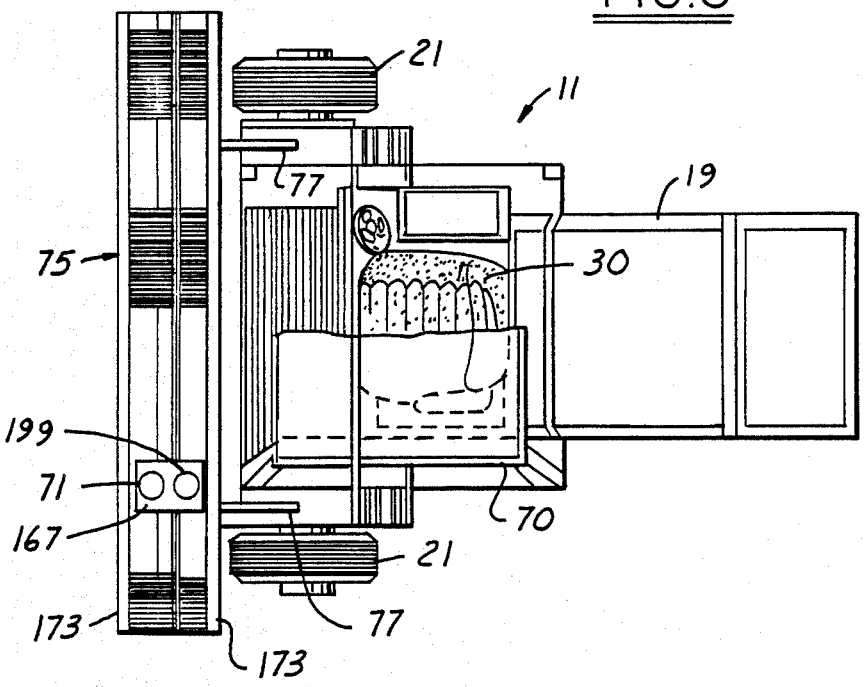
FIG. 3 is a partly broken away plan view of the water jet blasting vehicle upon which the carriage mounting hood is supported.
Figure 4:
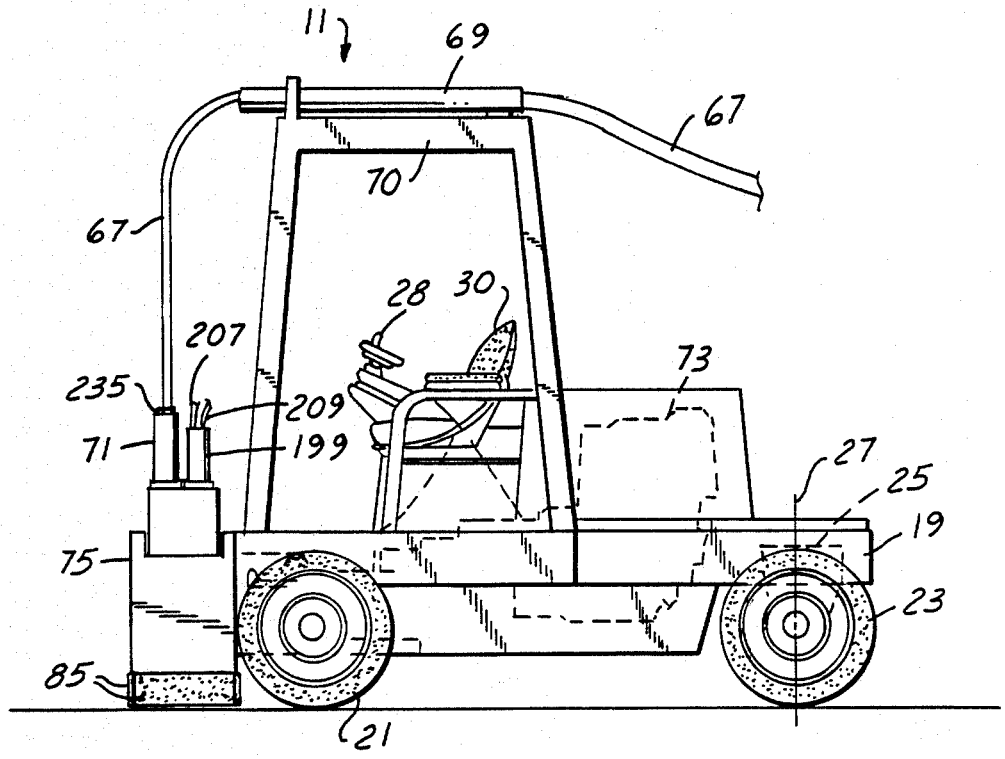
FIG. 4 is a side elevational view of the water jet blasting vehicle.

A transversly extending hood 75 is mounted rearwardly of vehicle frame 19 and the wheels 21 and is secured to the frame 19 by the pair of laterally spaced hood supports 77 suitable secured as by welding to hood 75 and to the frame 19, FIG. 3. A reciprocal feed carriage 79 is guidably mounted within and upon hood 75 in the inner zone of the hood for longitudinal movement along the length of the hood, FIG. 5 and 6.

The hood 75 includes opposed and spaced lower sidewalls 81 and end walls 83. The bottom of the hood 75 is spaced from the structural concrete or road bed 13. A flexible skirt 84, including skirt strips 85, preferably constructed of rubber, extend along the lower peripheral edges of the side and end walls 81 and 83 and are secured thereto as by spaced fasteners 87. The skirt 84 extends closely adjacent the structural concrete 13 defining a protective enclosure against the escape of debris or pressurized water from the high velocity sprays 231 which impinge upon the structural concrete at an acute angle, FIG. 6. The respective front and rear walls 81 of the hood 75 terminate in the inwardly directed top flanges 89. The top wall or partition 91 underlies flanges 89 and extends between the respective sidewalls 81 and end walls 83 defining the concrete break-up chamber 93, FIG. 6.

The opposed laterally spaced channels 95, sometimes referred to as beams, supporting V shaped guide rails 97 are mounted upon flanges 89 inwardly of upper sidewalls 171. Opposed elongated support plates 101 are secured to and extend inwardly of side walls 171 of the upper section of the hood 75 and mount the corresponding pair of channels 99 with underlying V shaped guide rails 97 secured thereto as shown in FIG. 6.

The mounting of feed carriage 79 includes the opposed beams 95 and 99 upon and along the interior of hood sidewalls 171 mounting the respective aligned guide rails 97. The laterally spaced pairs of longitudinally spaced guide wheels 103 with V grooves 105 are mounted between rails 97 and journaled upon stud shafts 107. The shafts 107 are secured to and project outwardly of bottom plate 109 of carriage 79. The foregoing assembly provides means by which the feed carriage 79 is guidably mounted within and upon the hood 75 for reciprocal movements in the inner zone thereof defined in part by the upper sidewalls 171.

The carriage 79 has a frame which includes a pair of upright opposed sidewalls 111 secured at 113 to bottom plate 109. The upper ends of the sidewalls 111 are connected a pair of laterally extending top plates or carriage drive plates 115 with suitable corner reinforcements at 117. Depending from plates 115 upon opposite sides of the hood 75 are a pair of opposed brackets 119 which are secured to the plates 115 by fasteners 121 as shown in FIG. 6. Each pair of brackets 119 carry a stub shaft 120 for the sprocket clamp 123. Clamps 123 are adapted to receive and be secured to the opposed continuous reciprocal sprocket chains 125 arranged upon opposite sides of the carriage 79 within the hood 75 and inwardly of the upper side walls 171 of the hood as shown in FIG. 6.

A pair of laterally spaced drive sprockets 127 are provided. Each drive sprocket 127 is secured upon an end of the rotatable drive shaft 129 which is mounted upon suitable bearings within laterally spaced brackets 131, FIG. 5. The respective sprocket chains 125 at their other ends extend around the idler sprockets 133 which are supported by brackets 131 and corresponding bearings adjacent the opposite end of hood 75, FIGS. 5 and 7. The respective brackets 131 for the corresponding drive sprockets 127 and idler sprockets 133 underlie and are secured to the corresponding side flanges 173 which project inwardly at the upward ends of the upper sidewalls 171 of hood 75.

Figure 5:
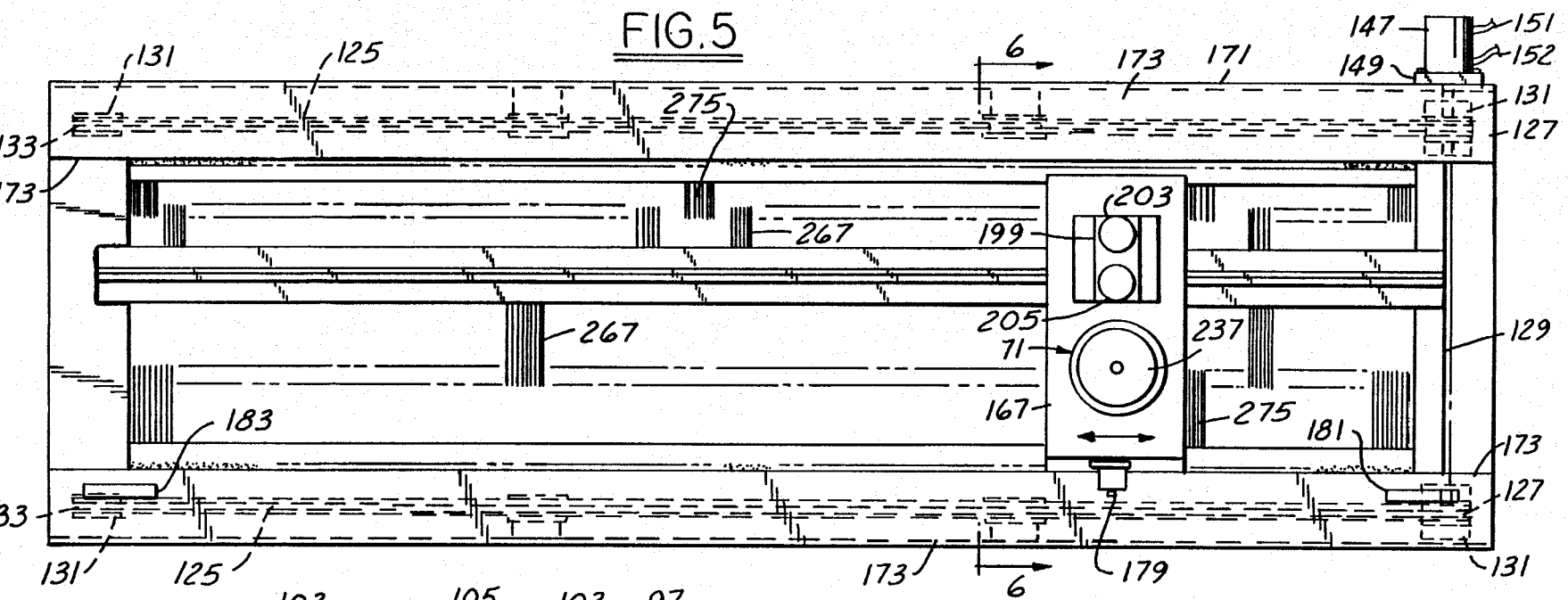
FIG. 5 is a plan view of the hood illustrated in FIGS. 3 and 4 on an increased scale.
Figure 7:
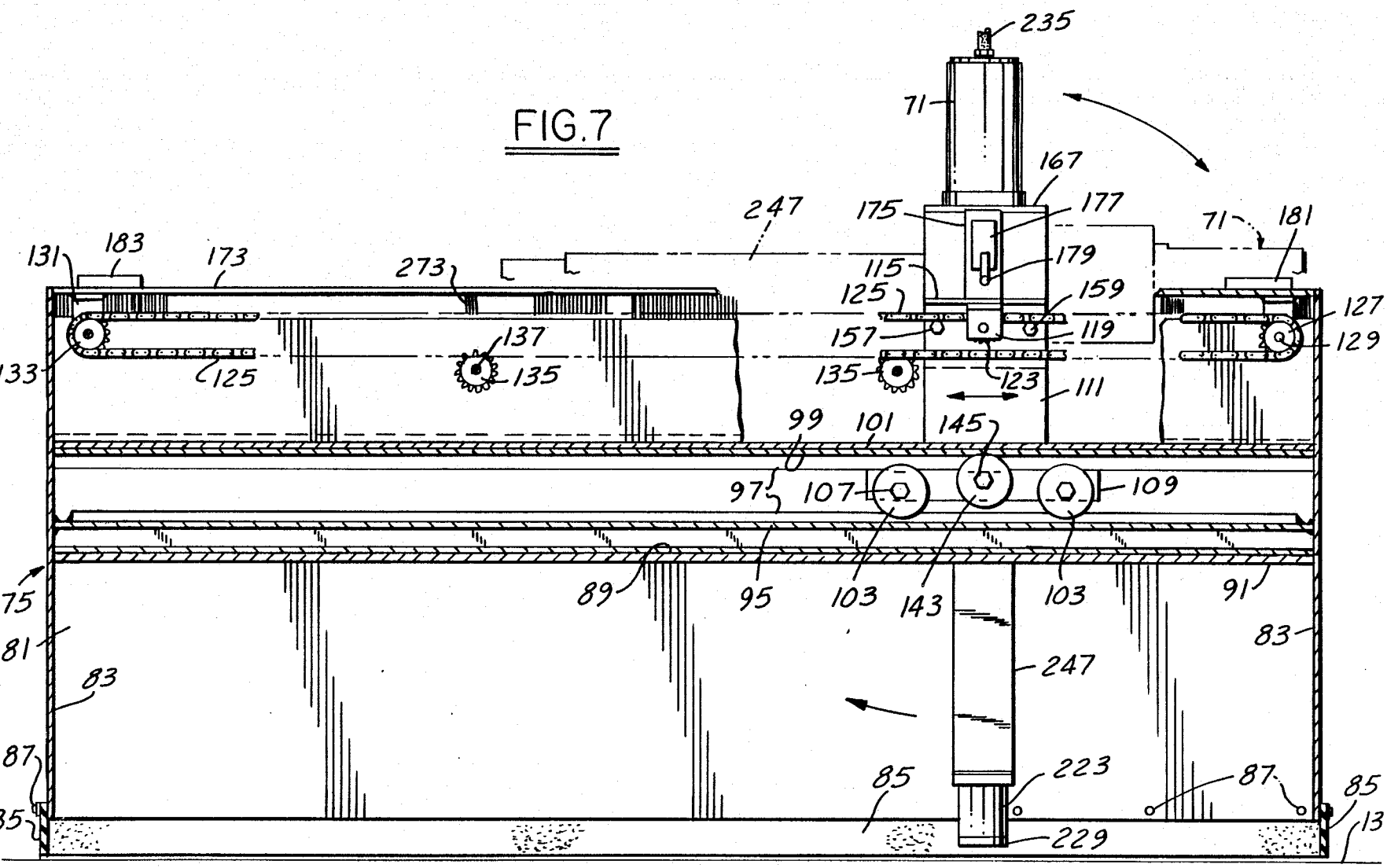
FIG. 7 is a vertical view, partly in section, taken in the direction of arrows 7—7 of FIG. 6 and showing the elongated shaft and nozzle assembly in a vertical operating position and in a generally horizontal inspection and service position.

As shown in FIGS. 5, 6 and 7, additional longitudinally spaced idler chain support sprockets 135 are journaled upon stud shafts 137 supported upon internal brackets 139 secured to sidewalls 171, as an example, by welds 141.

Mounted upon the respective opposite sides of carriage 79 and between the corresponding rollers 103 are a pair of opposed shafts 145 supporting the guide rollers 143 which move along the under surface of upper channels 99 to stabilize the carriage 79.

Figure 10:
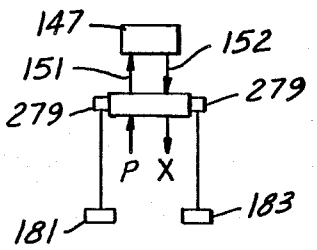
FIG. 10 is a schematic diagram of the hydraulic and electrical connections to the hydraulic motor for the feed carriage.

Reversible hydraulic or fluid motor 147, FIG. 5, includes a mount flange 149 secured to one sidewall 171 of hood 75, and a pair of pressure fluid conduits 151 and 152 adapted for selective connection to a source of pressurized fluid, as shown schematically in FIG. 10. Reversible motor 147 controls the direction of rotation of drive shaft 129 and corresponding drive sprockets 127 for effecting intermittent longitudinal feed movements of carriage 79 along the length of hood 75.

Seal support 153, FIG. 6, which forms a part of the present seal support housing including seal support plate 167, overlies the corresponding sidewalls 111 of carriage 79 and includes a pair of depending spaced mount plates 155 which bear against the interior surface of side plates 111. Plates 155 are secured to carriage side plates 111 by longitudinally spaced opposed pairs of fasteners 157 and 159, FIGS. 6 and 7. Seal support housing and its support plate 153 includes portions, namely the mount plates 155 which depend therefrom bear against the interior surface of side walls 111 within the inner zone of the hood 75, normally referred to as a generally non-accessible zone, and are connected thereto by fasteners 157 and 159.

Interposed between the seal support 153 and seal support plate 167 are the end walls or spacers 161. Cover panels 163 having upon their interior removable stick on insulating foam material are interposed between seal support 153 and seal support plate 167 and secured thereto by fasteners 169, defining sealed chamber 165 within the seal support housing.

The respective upper side plates 171 of hood 75 at their upper ends terminate in the inwardly directed opposed top flanges 173 and define therebetween an elongated slot 174 at the top of the hood 75. The slot 174 is interposed between the generally non-accessible inner zone of the hood 75 and the outer accessible zone above the hood 75 and communicating with slot 174.

Mounted upon carriage 79 and upon the top plate 115 secured to the carriage is an upright support plate 175 movable therewith and mounting the limit switch contactor 177 with limit switch contact 179 depending therefrom (FIG. 7). A pair of longitudinally spaced limit switches 181 and 183, FIG. 5, are arranged upon opposite ends of the hood 75 and are mounted and secured upon top flange 173, in alignment with limit switch contact 179. In operation, the limit switch contact 179 upon the carriage 79 at the end of its feed movements in either direction engages one of the limit switches 181 and 183 alternately for automatically reversing the connections to the hydraulic directional control valve or valve means 277, schematically shown in FIG. 10, for determining flow of the hydraulic fluid to either of the conduits 151 and 152 and then to hydraulic motor 147.

Referring to FIG. 6, a seal holder or ring 185 surrounds the lower end of body 72 of the seal assembly 71. The holder 185 is secured to the body 72 by a plurality of spaced fasteners 187. The ring 185 is affixed to seal support plate 167 by the bushing or mount plate 217 and the fasteners 218.

The rotating shaft and seal assembly 71 includes cylindrical body 72 and the axially depending seal tubular shaft 189 which is suitably journaled within body 72, in the manner disclosed in the co-pending patent application, Ser. No. 902,234. Tubular shaft 189 extends into sealed chamber 165 of the seal support housing 153, 167 and 161 and mounts pulley 191. Belt 193 extends around pulley 191 and is connected to the drive pulley 195 mounted upon driven shaft 197 within the sealed chamber 165 and which axially depends from the hydraulic motor 199. The motor 199 is mounted upon the seal support plate 167 and is secured thereto by fasteners 201, FIG. 6.

Overlying the hydraulic motor 199 are a pair of flanges 203 and 205 respectively receiving the hydraulic conduits 207 and 209. Another hose assembly or conduit 211 is provided with fittings 213 which are connected to parts of the motor 199 for assisting in reversing the motor when required. This depends upon whether the fluid under pressure is directed to one or the other of conduits 207 and 209 thus controlling the direction of rotation of driven shaft 197 within the sealed chamber 165. Rotating shaft 189 depends from body 72 and extends through bushing plate 217, secured upon the underside of housing plate 167, and into the chamber 165.

Elongated tubular shaft 215, sometimes referred to as a nozzle shaft tube, axially projects or extends into and is connected to the seal shaft tube 189 and is rotatable therewith. Elongated tubular shaft 215 depends below the seal support housing 153, 167 and at its lower end has a transverse mount flange 219 secured thereto of disc shape overwhich is secured the nozzle assembly 223 located, when in operation, at the bottom of the concrete break up chamber 93 as shown in FIG. 6.

The nozzle assembly 223 includes a collar adaptor 221 and a depending cylindrical rotatable nozzle block 223. In the illustrative embodiment there is disclosed a single nozzle 225 having a removable orifice 227 within bore 234. The bore 234 is inclined at an acute angle to the longitudinal axis of the nozzle block 223 and is in communication with fluid passage or bore 233, the interior of tubular shaft 215 and the water inlet 235 to the seal assembly 71. More than one nozzle may be employed in the nozzle assembly.

Protective nozzle cover 229 preferably constructed of steel, has suitable apertures in communication with orifice 227 to provide a high velocity water spray 231 under pressure for impingement at an acute angle against the structural concrete 13, FIG. 6.

At least a pair of opposed blind fasteners 235 extend through the mount flange 219, collar adaptor 221, and the nozzle block 223 into the nozzle cover 229. The nozzle cover 229 protects the nozzle block 223 and nozzle 225 against debris, dust and stones generated by the use of the apparatus.

Referring to FIG. 6, the body 72 for the rotating shaft and seal assembly 71 is closed at its upper end by a seal cover 237 which axially receives pressure fitting 235 corresponding to the water inlet. The fitting is connected to a source of water under pressure and includes the conduit 67, fragmentarily shown.

Longitudinally spaced radial bearings 239 are nested adjacent opposite ends of tubular bearing housing 241 which encloses the elongated tubular shaft 215. Housing 241 at its upper end has a mount flange 243 thereon secured to the under surface of the seal support 153 by a plurality of fasteners 244, FIG. 6. The respective radial bearings 239 receive corresponding spaced bushings 245 which are secured upon tubular shaft 215. The bearing housing 241 and corresponding bearings 239 therein retain the elongated tubular shaft 215 and nozzle assembly 223 in alignment with the power rotated seal shaft 189.

An elongated metallic protective sleeve 247, preferably of steel, encloses the bearing housing 241 along its length and extends to the nozzle assembly 223. At least a pair of longitudinally spaced O rings 249 are interposed between the sleeve 247 and bearing housing 241 to keep or maintain sleeve 247 steady upon or in alignment with the bearing housing 241.

Figure 9:
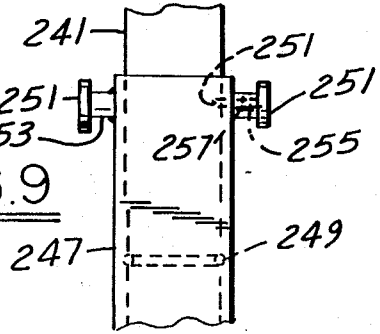
FIG. 9 is a fragmentary elevated view of the pair of opposed spring biased retractable lock pins for the protective sleeve enclosing the bearing housing, taken in direction of arrows 9—9 of FIG. 6.

Sleeve 247 is held or aligned with housing 241 by a pair of quick release spring loaded lock pins 251, FIGS. 6 and 9. Each pin 251 extends through a sleeve 253 secured to protective sleeve 247. An internal spring 255 engages shoulder 257 upon the pin 251 thereby normally holding the pin in registry within a corresponding aperture within bearing housing 241. Manual retraction of pins 251, permits longitudinal adjustment of sleeve 247 relative to the bearing housing 241, for access to the nozzle assembly. In the illustrative embodiment, in FIG. 8, the respective bearing housing 241 and protective sleeve 247 are square or rectangular in cross section.

Figure 8:
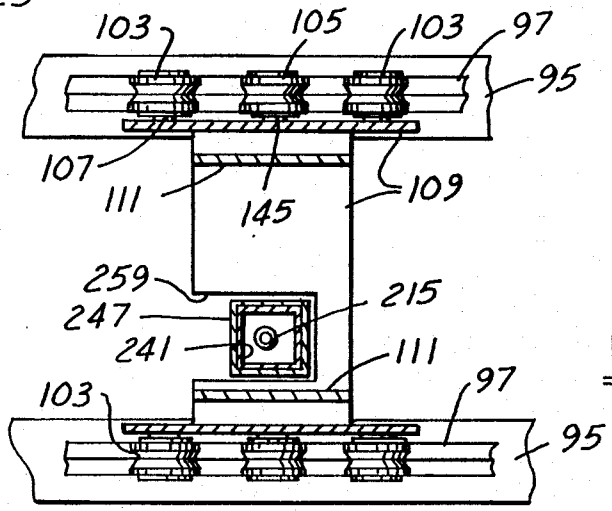
FIG. 8 is a fragmentary plan view of the roller mounting for the carriage of FIG. 6, taken in the direction of arrows 8—8.

As shown in FIGS. 6 and 8, bearing housing 241 extends from support plate 153 of the seal support housing downwardly through an elongated slot 259 within bottom plate 109 of carriage 79 and through an additional corresponding slot 261 formed through the partition 91 spanning the sidewalls 81 and endwalls 83. The rotating shaft and seal assembly 71 with the connected elongated tubular shaft 215, connected nozzle assembly 223, bearing housing 241 and protective sleeve 247 may be rotated thereby moving the elongated nozzle assembly through the slots 259 and 261 to a generally horizontal position within top slot 174 as shown in dotted lines in FIG. 7.

In the illustrative embodiment, the seal support 153 forming a part of the seal support housing and the depending mount plates 155 are secured to the upright sidewalls 111 of the carriage 79 by the opposed pairs of fasteners 157 and 159. With one of the pairs of fasteners removed, the other pair of fasteners serves as a pivot means by which the housing 153, 167 may be rotated from the position shown in FIG. 6 to the dash line position shown in FIG. 7 within the slot 174, i.e. to the outer zone of hood 75 which is accessible for maintenance purposes.

In the illustrative embodiment of FIG. 6, protective sleeve 247 extends down to and encloses mount flange 219 thereby protecting the same from rock, stones, debris and water. Upon retraction of the spring loaded pins 251, sleeve 247 may be elevated relative to bearing housing 241 sufficiently to expose the blind fasteners 235. This permits disassembly of the nozzle assembly 221, 223, 225 and 229. This function is performed after the elongated tubular shaft and nozzle assembly has been rotated from the inner non accessible zone through the hood slot 174 to the outer zone of the hood for maintenance purposes.

While the elongated tubular shaft and nozzle assembly is movable through the longitudinal opening 261 in partition 91 defining working chamber 93 of the hood 75, means are provided for sealing off the working chamber 93 from the upper portion of the hood 75 within which the carriage 79 is longitudinally adjustable. For this purpose, mounted upon opposite sides of opening 261 upon partition 91, are a pair of opposed inwardly directed linear bristles 263 which normally close off the elongated opening 261 and are arranged in the path of longitudinal and pivotal movement of protective sleeve 247. The bristles 263 normally close off water and debris from the upper chamber of the hood 75, FIG. 6.

Angle members 265, FIG. 6, extend through carriage 79 and mount a pair of outwardly directed linear bristles 267 which engage and extend in the path of pivotal movement of sleeve 247 and further engage the interior surface of the carriage sidewalls 111 to further seal off and exclude water from the interior of the carriage 79. Bristles 267 also close off top slot 174 in the path of reciprocal movement of carriage 79.

Additional upright side plates 269 spaced inwardly of hood walls 171 are secured upon support plates 101 and extend the length of hood 75 in order to isolate the sprocket chambers 271 from water. Additional linear bristles 273 extend from the upper ends of plates 269 to under surface portions of carriage plates 115 and into slot 174. Additional inwardly directed bristles 275 extend from lower portions of side plates 269 and normally into the path of carriage movement along the length of hood 75.

Referring to FIG. 10, there is schematically shown the reversible hydraulic motor 147 for the carriage drive sprockets 127 having a pair of pressure fluid conduits 151 and 152 corresponding to FIG. 5, which are connected to the directional control valve 277, schematically shown, connected to a source of pressure fluid P and having an exhaust designated at X.

The directional control valve 277 is of a conventional construction and includes a reciprocal valve element controlled by a pair of solenoids 279 at opposite ends of the directional control valve housing. The solenoids 279 normally maintain the movable valve element in one of a pair of control positions within the directional control valve 277.

With either of the solenoids 279 energized, with one of the limit switches 181, 183 in contact with contactor or contact 179 upon the carriage 79, one of the conduits 151, 152 receives hydraulic fluid from the directional control valve 277 for feeding the carriage 79 in a predetermined direction through the operation of drive shaft 129, operated by the hydraulic motor 147. Drive sprockets 127 on shaft 129 effect longitudinal movement of the sprocket chains 125 which are connected at 123 to the carriage 79.

When the contactor 179 reaches the end of the carriage feed movement and contacts the other limit switch, such as limit switch 183, the corresponding solenoid is energized and reverses the valve element within directional control valve 277 so that the hydraulic fluid is directed to other of the pair of conduits 151 and 152, reversing the operation of the hydraulic motor 147 and reversing the direction of feed movement of the attached carriage 79.

In the present construction, the elongated hood 75 has an inner zone corresponding to the chamber between the upper sidewalls 171, which is generally not accessible, and an outer zone, corresponding to an area above the hood 75 which is accessible for maintenance purposes. In such construction, the elongated slot 174 extends between the top flanges 173 of the hood and is arranged intermediate the inner and outer zones.

The seal support housing 153, 167 is movably positioned within the slot 174 in hood 75 and is supported upon carriage 79 which is reciprocally mounted upon the interior of the hood 75 within the inner non-accessible zone. The corresponding seal support housing overlies carriage 79 and is generally arranged in the outer zone above the hood 75.

Since a pivot means is provided as at 157 or 159 between the housing 153, 167 and the carriage 79, the housing may be rotated approximately 90 degrees. As a result thereof, the attached and depending tubular shaft 215 and nozzle assembly 221–223, the connected tube bearing housing 241, and protective tube 247 may be rotated from the upright position shown in FIG. 6 through slot 274 to a substantially horizontal position in the outer zone of the hood 75 for maintenance purposes, FIG. 7.

This provides a means by which the nozzle assembly may be removed, replaced, cleaned or repaired. With protective sleeve 247 released and elevated, relative to bearing housing 241, access to fasteners 235 is provided. Thus, the nozzle assembly and the parts thereof may be removed by loosening and removing the blind fasteners 235. Thereafter, the required maintenance is performed on the component parts of the nozzle assembly.

The respective tubular shaft 215 and the nozzle assembly 223 connected thereto, the bearing housing 241 and protective sleeve 247 on such pivotal movement moves within the clearance apertures or slots 259 and 261, FIG. 6, to the generally horizontal non-use position sometimes referred to as a service or maintenance position for inspection, repair, or replacement of any component parts of the nozzle assembly, FIG. 7.

Having described my Invention reference should now be had to the following claims.

We claim:

1. An apparatus for removing structural concrete comprising:

an elongated hood having an inner zone and an outer zone; said inner zone being generally nonaccessible; and said outer zone being accessible for maintenance purposes;

said hood having an elongated slot extending along the length thereof and located between said inner and outer zones;

a feed carriage guidably mounted within and upon said hood in the inner zone thereof for longitudinal reciprocal movement along the length of said hood;

a seal support housing overlying said carriage and located substantially in the outer zone of said hood;

said support housing including portions extending through said slot into said inner zone for connection to said carriage;

pivot means interposed between said housing portions and said carriage;

a rotating shaft and seal assembly mounted upon said support housing and including a body having a water inlet adapted to be connected to a source of water under pressure; and an elongated tubular shaft and nozzle assembly having a generally vertical operating position, axially connected to said rotating seal and shaft assembly and extending from said support housing in said outer zone through said slot into said inner zone and through said carriage into the bottom of said hood for directing water under pressure against the structural concrete;

said support housing being adapted to pivot about said pivot means to swing and thereby move said tubular shaft and nozzle assembly from the vertical operating position to a generally horizontal inspection and service position for maintenance purposes.

2. The apparatus for removing structural concrete of claim 1 further comprising:

said hood being spaced from the structural concrete; and a peripheral skirt of flexible material mounted upon, secured to and depending from the bottom of said hood, with lower portions of said skirt extending throughout 360 degrees and being located closely adjacent the structural concrete thereby defining a protective enclosure against the escape of debris from the hood.

3. The apparatus for removing structural concrete of claim 1 further comprising:

said source of water under pressure including a water storage and pump vehicle movable on the structural concrete;

a pressurized water storage tank on the vehicle;

a power operated pump on the vehicle having an intake connected to a water source and a outlet connected to the tank; and a pump discharge manifold connected to the tank and having a high pressure water outlet connected to said water inlet.

4. The apparatus for removing structural concrete of claim 1 further comprising:

said hood having spaced opposed sidewalls;

said feed carriage including spaced opposed sidewalls and a bottom plate;

the mounting of said feed carriage including opposed beams mounted along the interior of said hood;

aligned guide rails along the top and bottom of each beam;

laterally spaced pairs of longitudinally spaced guide wheels journaled upon opposite sides of said carriage and in cooperative registry with said guide rails respectively;

said seal support housing having a seal support spanning and overlying said carriage side walls and secured thereto for normal longitudinal feed movements; and said pivot means including removable fasteners interconnecting said support housing portions and carriage sidewalls whereby said seal support housing is adapted for pivoting to a non-use position, there being a corresponding clearance slot in said bottom plate for the passage of said tubular shaft and nozzle assembly to said inspection and service position.

5. The apparatus for removing structural concrete of claim 1 further comprising:

power means mounted upon said support housing connected to said tubular shaft and including a reversible hydraulic motor; and a pair of conduit fittings upon said motor selectively connectible to a source of fluid under pressure for controlling rotation of said hydraulic motor.

6. The apparatus for removing structural concrete of claim 1 further comprising:

said seal support housing including a seal support overlying said carriage;

a seal support plate spaced above said seal support;

a power means including a drive shaft mounted upon said seal support plate;

said body being mounted upon said support plate; and a peripheral sidewall enclosure extending between said seal support and seal support plate defining a chamber;

said power means drive shaft and said rotating shaft and the drive connections therebetween being enclosed within said chamber.

7. The apparatus for removing structural concrete of claim 1 further comprising:

said pivoting movement being substantially 90 degrees.

8. The apparatus for removing structural concrete of claim 1 further comprising:

said feed carriage including spaced opposed sidewalls and a bottom plate;

said seal support housing having a seal support spanning and overlying said carriage sidewalls and secured thereto for normal longitudinal feed movements; and said pivot means including removable fasteners interconnecting said support housing portions and carriage sidewalls, whereby said seal support housing is adapted for pivotng to a non-use position, there being a corresponding clearance slot in said bottom plate for the passage of said tubular shaft and nozzle assembly to said inspection and service position.

9. The apparatus for removing structural concrete of claim 8 further comprising:

the securing of said seal support to said carriage sidewalls including spaced opposed depending mount plates upon said seal support bearing against the interior of said carriage sidewalls; and opposed pairs of longitudinally spaced fasteners extending between said mount plates and carriage sidewalls respectively;

said pivot means including one of said pairs of fasteners; whereby upon removal of the other of said pairs of fasteners, said mount plates may be pivoted around said one of said pairs of fasteners to said inspection and service position.

10. The apparatus for removing structural concrete of claim 1 further comprising: an elongated normally upright tubular bearing housing coaxial with and loosely enclosing said tubular shaft, at one end rigidly secured to and depending from said support housing; and longitudinally spaced bearings interposed between said bearing housing and said tubular shaft, said nozzle assembly being spaced from the other end of said bearing housing.

11. The apparatus for removing structural concrete of claim 10 further comprising:

said bearings being radial bearings mounted within said bearing housing; and bushings retained upon said tubular shaft extending through said radial bearings.

12. The apparatus for removing structural concrete of claim 10 further comprising:

an elongated sleeve slidably positioned over and protectively enclosing said bearing housing;

longitudinally spaced O-rings interposed between said sleeve and bearing housing; and opposed spring biased retractable lock pin means upon said sleeve for retainingly engaging said bearing housing.

13. The apparatus for removing structural concrete of claim 1 further comprising:

the mounting of said nozzle assembly including a radial mount flange axially secured upon one end of said tubular shaft;

a radial collar adaptor upon said nozzle assembly bearing against said mount flange; and fastening means interconnecting said mount flange, collar adaptor and nozzle assembly.

14. The apparatus for removing structural concrete of claim 13 further comprising:

said nozzle assembly including a cylindrical nozzle block having an end face and depending from said collar adaptor and including a bore communicating with said tubular shaft and with a portion of said bore extending to said end face at an acute angle to said axis and mounting a nozzle having a converging orifice outletting at said end face; and an apertured cover mounted over said end face and removably secured thereto, through which said pressurized water flows, said fastening means extending through said nozzle block and cover.

15. The apparatus for removing structural concrete of claim 1 further comprising:

power means for effecting longitudinal reciprocal movements of said carriage including a horizontally disposed continuous sprocket chain with its ends extending to and mounted respectively around drive and idler sprockets adjacent opposite ends of said hood outwardly of said carriage;

a reversible motor mounted upon said hood including a drive shaft extending transversely of and mounted upon said hood and connected to the said drive sprocket; and clamp means upon said carriage receiving and secured to said sprocket chain.

16. The apparatus for removing structural concrete of claim 15 further comprising:

said reversible motor being a fluid motor having a pair of pressure fittings adapted for selective connection to a source of fluid under pressure.

17. The apparatus for removing structural concrete of claim 16 further comprising:

reversible solenoid controlled valve means selectively connected to said motor pressure fittings and to a source of pressurized fluid;

a pair of opposed longitudinally spaced limit switches mounted upon said hood adjacent its opposite ends; and a limit switch contactor upon said carriage aligned with and at the end of its feed movements in either direction energizing one of said limit switches for automatically reversing the connections to said valve means.

18. The apparatus for removing structural concrete of claim 1 further comprising:

said hood having spaced opposed sidewalls and end walls;

said carriage including spaced opposed sidewalls and a bottom plate; and an apertured partition wall spaced from said bottom plate interposed between said hood side and end walls defining a concrete breakup chamber down into which said tubular shaft and nozzle assembly project for isolating said carriage from water and debris.

19. The apparatus for removing structural concrete of claim 18 further comprising:

said partition wall having a clearance slot therein receiving said tubular shaft, said tubular shaft and nozzle assembly being adapted to swing through said slot when said seal support housing is rotated to a maintenance position.

20. The apparatus for removing structural concrete of claim 19 further comprising:

spaced opposed upright sidewalls mounted upon the interior of said hood spaced outwardly of said carriage side plates and extending substantially the length of said hood; and a series of longitudinally extending linear yieldable bristles mounted upon said partition slot upon opposite sides of and normally closing the partition slot opening during longitudinal movements of the nozzle shaft, and additional linear yieldable bristles extending from said side plates into the path of said carriage yieldably closing off the path of reciprocal movement of said carriage for sealing off moisture and debris from the interior of said carriage.

21. The apparatus for removing structural concrete of claim 20 further comprising:

additional linear bristles extending between said side plates and lateral portions of said carriage for excluding moisture from said carriage.

22. Apparatus for removing structural concrete comprising a vehicle movable upon a road bed;

an elongated transversely extending downwardly opening hood mounted upon one end of the vehicle overlying the road bed;

a feed carriage guidably mounted within and upon said hood for longitudinal reciprocal movements along its length;

a seal support housing overlying said carriage and secured thereto and positioned above said hood;

a rotating seal and shaft assembly including an upright body having a water inlet adapted to be connected to a source of water under pressure;

an upright rotatable tubular shaft journaled and supported within said body and depending therefrom and into said housing and communicating with said water inlet;

power means mounted upon said housing including a drive shaft extending into said housing and connected to and rotating said tubular shaft;

an elongated tubular nozzle shaft axially connected to said tubular shaft within said housing, and extending from said housing through said carriage and into the bottom of said hood;

a nozzle assembly having an end face and arranged upon a vertical axis, axially mounted upon one end of said nozzle shaft and secured thereto;

said nozzle assembly including a nozzle block having a bore extending to said end face at an acute angle to said axis and communicating with said nozzle shaft;

a nozzle having an orifice communicating with said bore and secured within said nozzle block and outletting at its end face;

said hood having an elongated slot in its top along the length thereof, through which said seal support housing extends, said housing moving along the length of said slot on reciprocal movements of said feed carriage;

the sequential and pulverizing action of the water in a rotating 360 degrees pattern discharged from said rotating nozzle impinging against the concrete under high pressure throughout continuous 360 degrees cycles as the feed carriage is moved back and forth over the work area of the road bed resulting in the pressurized water removing structural concrete to a required depth and removing surface scale and corrosion from the concrete reinforcing bars without damage thereto.

23. Apparatus for removing structural concrete comprising a vehicle movable upon a road bed;

an elongated transversely extending downwardly opening hood mounted upon the vehicle and overlying the road bed;

a feed carriage guidably mounted within and upon said hood for longitudinal reciprocal movements along its length;

a seal support housing overlying said carriage and secured thereto and positioned above said hood, said housing being adapted for pivoting 90 degrees to a non-use position;

a rotating seal and shaft assembly mounted upon said housing including an upright body having a water inlet adapted to be connected to a source of water under pressure in the range up to 25,000 p.s.i;

an upright rotatable tubular shaft journaled and supported within said body and depending therefrom and into said housing and communicating with said water inlet;

power means mounted upon said housing including a drive shaft extending into said housing and connected to and rotating said tubular shaft;

an elongated tubular nozzle shaft axially connected to said tubular shaft within said housing, and extending from said housing through said carriage and into the bottom of said hood;

a nozzle assembly having an end face and arranged upon a vertical axis, axially mounted upon one end of said nozzle shaft and secured thereto;

said nozzle assembly including a bore communicating with said nozzle shaft and with a portion of said bore extending to the end of said block at an acute angle to said axis and mounting a nozzle having a converging orifice outletting at said end face;

said hood having an elongated slot in its top along the length thereof, through which said seal support housing extends, said housing moving along the length of said slot on reciprocal movements of said feed carriage;

sequential and pulverizing action of the water in a rotating 360 degrees pattern discharged from said rotating nozzle impinging against the concrete under high pressure throughout continuous 360 degrees cycles as the feed carriage is moved back and forth over the work area of the road bed resulting in the pressurized water removing structural concrete to a required depth and removing surface scale and corrosion from the concrete reinforcing bars without damage thereto, said nozzle shaft and nozzle assembly pivoting to a horizontal position within said slot when said support housing is in a non- use position.

24. A nozzle construction comprising:

an elongated tubular shaft open at both ends, with one end adapted to be connected to a source of water under pressure:

a nozzle assembly connected to the other end of said shaft:

an elongated normally upright tubular bearing housing co-axially with and loosely enclosing said tubular shaft:

longitudinally spaced bearings interposed between said bearings housing and said tubular shaft, said nozzle assembly being spaced from said bearing housing:

an elongated sleeve slidably positioned over and protectively enclosing said bearing housing;

longitudinally spaced O-rings interposed between said sleeve and bearing housing; and opposed spring biased retractable lock pin means upon said sleeve for retainingly engaging said bearing housing.

25. The nozzle construction defined in claim 24 further comprising:

said bearings being radial bearings mounted within said bearing housing; and bushings mounted on said tubular shaft and extending through said radial bearings.

26. The nozzle construction defined in claim 24 further comprising:

the mounting of said nozzle assembly including a radial mount flange axially secured upon said other end of said tubular shaft;

a radial collar adaptor upon said nozzle assembly bearing against said mount flange; and fastening means interconnecting said mount flange, collar adaptor and nozzle assembly.

27. A nozzle construction comprising:

an elongated tubular shaft open at both ends, with one end adapted to be connected to a source of water under pressure:

a nozzle assembly connected to the other end of said shaft:

an elongated normally upright tubular bearings housing co-axially with and loosely enclosing said tubular shaft:

longitudinally spaced bearings interposed between said bearing housing and said tubular shaft, said nozzle assembly being spaced from said bearing housing:

said nozzle assembly including a nozzle block having one or more removable nozzles therein;

said nozzle block having on one end a radial mount flange axially secured upon said other end of said tubular shaft;

said nozzle block having on the other end a flat surface with an opening through which the water under pressure is discharged from the nozzle; and a removable cover plate engagable with said flat surface of the nozzle block, said cover plate having an opening for the discharged water under pressure;

said cover plate protecting said nozzle and flat surface of said nozzle block from erosion.

* * * * *